United States Patent [19]

Egashira et al.

[11] Patent Number: 4,908,345

[45] Date of Patent: Mar. 13, 1990

[54] DYE RECEIVING

[75] Inventors: Noritaka Egashira, Ichikawa; Hitoshi Arita, Tokyo, both of Japan

[73] Assignee: Dai Nippon Insatsu Kabushiki Kaisha, Japan

[21] Appl. No.: 163,757

[22] PCT Filed: Jun. 30, 1987

[86] PCT No.: PCT/JP87/00439

§ 371 Date: Apr. 11, 1988

§ 102(e) Date: Apr. 11, 1988

[87] PCT Pub. No.: WO88/00139

PCT Pub. Date: Jan. 14, 1988

[30] Foreign Application Priority Data

Jun. 30, 1986 [JP] Japan ..... 61-152925
Jun. 30, 1986 [JP] Japan ..... 61-152926
Jun. 30, 1986 [JP] Japan ..... 61-152927

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/471; 428/480, 913, 428/914, 195; 503/227; 528/176

[56] References Cited

U.S. PATENT DOCUMENTS 4,097,230 6/1978 Sandhu ..... 503/227

*Primary Examiner*—Bruce H. Hess
*Attorney, Agent, or Firm*—Arnold, White & Durkee

[57] ABSTRACT

The dye receiving sheet according to the present invention is a sheet to be used in combination with a heat transfer sheet provided with a dye layer, and comprises a receiving layer (3) for receiving the dye migrating from the above heat transfer sheet during heating printing formed on at least one surface of a sheet substrate (2). A specific feature of the dye receiving sheet according to the present invention is that the above receiving layer (3) comprises a specific modified polyester resin, namely, a phenyl group modified polyester resin and/or a long chain methylene group modified polyester resin, and by constituting the receiving layer (3) of such a resin, the dyeability of the printed image can be improved, and further the light resistance (weathering resistance) of the image obtained can be improved.

25 Claims, 1 Drawing Sheet

FIG. 1
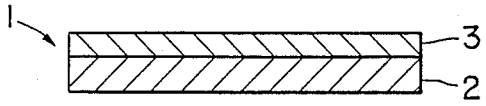
FIG. 2
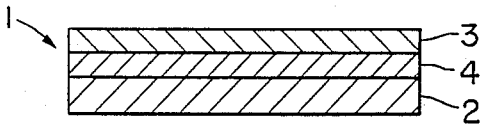
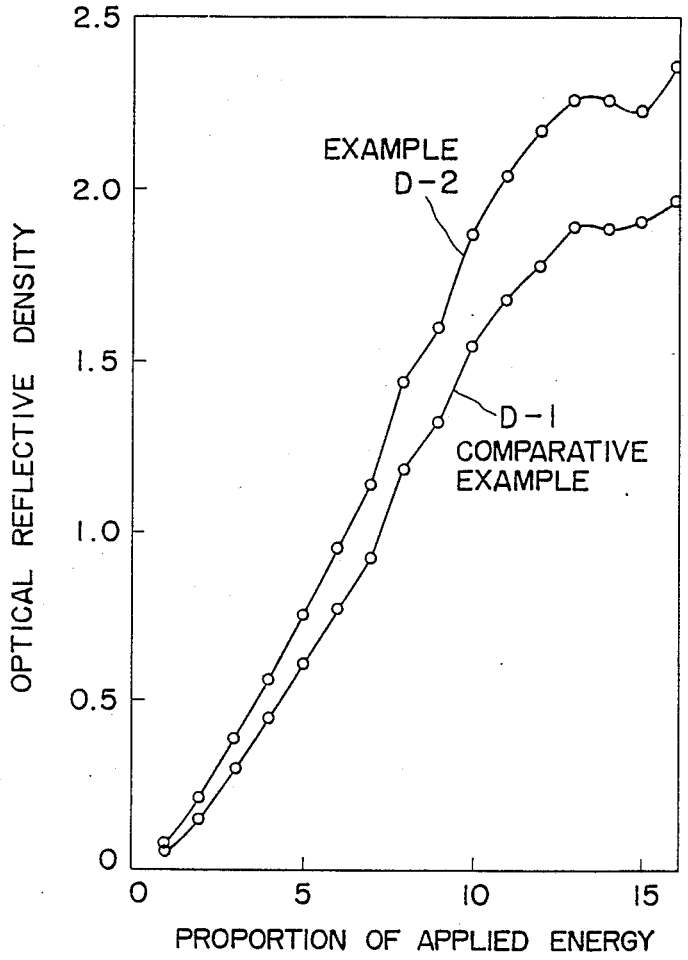
FIG. 3

DYE RECEIVING

BACKGROUND OF THE INVENTION

This invention relates to a dye receiving sheet, i.e., a sheet to be heat transfer printed, which is to be used for image formation according to the sublimation transfer method, more particularly to a dye receiving sheet of excellent dye dyeability and/or light resistance (weathering resistance) of transferred image to be used in combination with a heat transfer sheet.

Attempts are being made to heat a heat transfer sheet having a dye layer containing sublimable disperse dye formed thereon in dot shapes corresponding to image signals by a heating printing means such as a thermal head and form an image comprising the dye migrated from the above heat transfer sheet on the surface of a dye receiving sheet.

However, in the heat dye receiving of the prior art, dyeability of the dye is not necessarily sufficiently good, and when an image with high density is desired, a correspondingly excessive heat content is required during printing. For this reason the energy load on the thermal head is inevitably increased, whereby the thermal head driving voltage becomes undesirably great.

Also, in the dye receiving sheet of the prior art, light resistance and weathering resistance of the image formed have not been sufficient, and sharpness of the image once formed can be lowered or discolored with time. This may be considered to be because of the existence of the dye migrated from the heat transfer sheet side by the thermal head, etc. in the vicinity of the surface of the receiving layer of the heat transfer sheet, which particularly affects susceptibility to light or humidity.

SUMMARY OF THE INVENTION

Accordingly, in the present invention, it is an object to improve the dyeability of dyes by eliminating the drawbacks of the above dye receiving sheet of the prior art and/or to improve light resistance (and weathering resistance) of the image formed by migration of dyes.

The present inventors have undertaken intensive studies in order to ameliorate the above dyeability and light resistance (weathering resistance) which are particularly problems in the performances of dye receiving sheets and consequently found that the above characteristics can be remarkably improved by forming the receiving layer of the dye receiving sheet by the use of a modified polyester obtained by introducing a specific group into a polyester resin.

More specifically, the dye receiving sheet is a sheet to be used in combination with a heat transfer sheet having a dye layer containing a dye which is migrated by fusion or sublimation by heat, comprising (a) a sheet substrate and (b) a receiving layer formed on at least one surface of the sheet substrate for receiving the dye migrating from said heat transfer sheet during heating printing, characterized in that said receiving layer comprises a modified polyester resin.

In the present invention, the above modified polyester resin comprises specifically a phenyl group modified polyester resin synthesized by use of a polyol having a phenyl group as the polyol component and/or a long chain methylene group modified polyester resin synthesized by use of a dicarboxylic acid having a long methylene group as the acid component.

Of the above modified polyester resins, the phenyl group modified polyester resin has excellent effect in improvement of dye dyeability, while the long chain methylene group modified polyester resin exhibits excellent effect in improvement of light resistance (weathering resistance).

BRIEF DESCRIPTION OF THE DRAWINGS

FIG. 1 and FIG. 2 are sectional views of heat transferable sheets according to Examples of the present invention, respectively; and FIG. 3 is a graph of the optical reflective density versus applied energy.

DETAILED DESCRIPTION OF THE INVENTION

As shown in FIG. 1, the dye receiving sheet 1 according to the present invention has a receiving layer 3 for receiving the dye migrating from the heat transfer sheet during heating printing formed on the surface of a sheet substrate 2. Also, in the dye receiving sheet of the present invention, an intermediate layer 4 can be also formed between the sheet substrate 2 and the receiving layer 3. Also, in the present invention, although not shown, receiving layers 3 may be also formed on both surfaces of the sheet substrate 2. In the following, the constitution of the dye receiving sheet of the present invention is described in detail.

Sheet substrate

As the sheet substrate 2, it is possible to use (1) synthetic paper (polyolefin type, polystyrene type, etc.), (2) wood-free paper, art paper, coated paper, cast coated paper, wall paper backing paper, synthetic or emulsion impregnated paper, synthetic rubber latex impregnated paper, synthetic resin added paper, board paper, or natural fiber paper such as cellulose fiber paper, (3) films or sheets of various plastics such as polyolefin, polyvinyl chloride, polyethylene terephthalate, polystyrene, methacrylate, and polycarbonate. Among them, the synthetic paper of (1) is preferable since it has a microvoid layer with low thermal conductivity (in other words, high thermal insulation) on its surface. Also, a laminated product by any desired combination of the above (1) to (3) can be used. As a typical example of the laminated product, a laminated product of a cellulose fiber paper and a synthetic paper, or of a cellulose fiber paper and a plastic film or sheet may be mentioned. Among them, the laminated product of a cellulose fiber paper and a synthetic paper has an advantage in that thermal instability (stretch and shrink) possessed by the synthetic paper is compensated for by the cellulose fiber, whereby high printing heat sensitivity owing to low thermal conductivity possessed by the synthetic paper can be exhibited. Also, in this combination, for balance between the front and the back of the laminated product, it is preferable to use a laminate of the three layers of synthetic paper-cellulose fiber paper-synthetic paper, whereby curling due to printing can be reduced.

As the synthetic paper to be used in the laminated product as described above, any material available as the substrate for the dye receiving sheet can be generally used, but particularly a synthetic fiber provided with a paper-like layer having microvoids (e.g. commercially available synthetic paper, produced by Oji-Yuka Goseishi) is desirable. The microvoids in the above paper-like layer can be formed by, for example, stretching a synthetic resin under a state wherein it contains fine fillers. The forming of the dye receiving sheet by the use of the synthetic paper provided with the above paper-like layer having the microvoids has the effect of providing high image density without variance in images when images are formed by heat transfer. This may be considered to be due to thermal insulation effect due to the microvoids, good thermal efficiency, good cushioning property due to the microvoids, which will contribute to improvement of the performance of the receiving layer provided on the above synthetic paper and on which images are to be formed. It is also possible to provide a paper-like layer containing the above microvoids directly on a core material such as cellulose fiber paper, etc.

Other than the cellulose fiber paper in the above laminated product, a plastic film can be also used, and further a laminate of the above cellulose fiber paper with a plastic film can be used.

As the method for causing a synthetic paper to adhere to a cellulose fiber paper, there may be included, for example, sticking with the use of an adhesive known in the art, sticking by the extrusion lamination method, sticking by hot melt adhesion. On the other hand, as the method for causing adhesion of a synthetic paper with a plastic film, there may be included the lamination method which also forms a plastic film at the same time and adhesion by the calendering method. The above adhesion methods are suitably selected depending on the materials to be stuck with the synthetic paper. Specific examples of the above adhesive are emulsion adhesives such as of ethylene-vinyl acetate copolymer, and polyvinyl acetate; water-soluble adhesives of carboxyl-containing polyesters, while adhesives for lamination are organic solvent solution types such as of polyurethane and acrylic polymers.

Receiving layer

The material constituting the receiving layer 3 is a layer for receiving (image receiving) the dye migrating from the heat transfer sheet, for example, an image of a sublimable disperse dye, and maintaining the image formed by receiving.

In the present invention, the receiving layer 3 is formed of a modified polyester resin having a phenyl group and/or long chain methylene group in the main chain.

The molecular weight of the modified polyester resin is preferably about 10,000 to 30,000, with a polymerization degree of about 100 to 200.

Incorporation of a phenyl group into the main chain is accomplished by the use of a polyol having a phenyl group. In this case, the polyol containing a phenyl group is preferably about 1 to 100 mol% of the polyols employed.

The dye receiving sheet prepared by the use of the above modified polyester has excellent dyeability of dyes, probably because the dispersibility of the dye is enhanced by its containing a phenyl group which serves to form readily the amorphous state of the polymer. According to the knowledge of the present inventors, this tendency is more marked when phenyl group is present in the main chain rather than in the side chain. Also, increased solubility or affinity of dyes, particularly anthraquinone type dyes into the polymer by inclusion of phenyl group may be also considered to contribute to the dyeability of dyes.

On the other hand, when the modified polyester resin has a long chain methylene group, the weathering resistance of the dyed dye is improved. This may be considered to be because the number of the ester bonds in the polyol is relatively reduced, and therefore the probability of active hydrogens generated at the sites of ester bonds by optical excitation is reduced, whereby photodecomposition in the presence of oxygen or water causing deterioration of dyes does not readily occur. In this sense, the dicarboxylic acid as the acid component (shown below):

$$HOOC(CH_2)_nCOOH$$

should desirably contain methylene groups in number of $n \geqq 6$, with the upper limit being $n \leqq 30$. Such dicarboxylic acid containing long chain methylene groups should be desirably contained in a proportion of 20 to 100 mol% of the acid components during synthesis.

The dye receiving sheet having the receiving layer constituted of the long chain methylene group modified polyester resin as described above has an excellent effect in improving light resistance, particularly exhibiting a further excellent light resistance improving effect when the dye constituting the heat transfer sheet is a sublimable anthraquinone type dye. Examples of such sublimable anthraquinone type dyes are Solvent Blue 63, 59, 36, 14, 74, Solvent Violet 14, 11, Disperse Red 60, 3, Disperse Violet 26, and Disperse Blue 26, 40. When these dyes are employed in combination with a phenyl containing polyester resin, light resistance is good and there is little color fading under grade 3 irradiation according to JIS specification.

The modified polyester resin in the present invention, accordingly, can be synthesized by the use of the modified acid component represented by the following formula (I) and/or the modified polyol.

Modified acid component:

$$HOOC(CH_2)_nCOOH \quad (I)$$

wherein n is preferably $6 \leqq n \leqq 30$.

Modified polyol component:

bisphenol A;
bisphenol B;
bisphenol AF;
bisphenol S.

Alternatively, other than the above components, a polyol component containing no phenyl group may be used in combination, and also a compound of the above formula (I) having a methylene group with $n < 5$ may be used in combination as an acid component.

The respective components during synthesis are not required to be of a single kind, and a plurality of kinds can be also used in combination.

The modified polyester resin can be also used in combination with another resin to constitute the receiving layer.

For example, synthetic resins (a) to (e) shown below can be used singly or as a mixture of two or more kinds.

(a) Those having ester bonds:
polyester resins (other than phenyl modified ones), polyacrylic ester resins, polycarbonate resins, polyvinyl acetate resins, styrene-acrylate resins, vinyl toluene-acrylate resins, etc.

(b) Those having urethane bonds:
polyurethane resins, etc.

(c) Those having amide bonds;
polyamide resins (nylon).

(d) Those having urea bonds:

urea resins, etc.

(e) Others having highly polar bonds:

polycaprolactone resins, polystyrene resins, polyvinyl chloride resins, polyacrylonitrile resins, etc.

For example, the receiving layer 3 can be constituted of a resin mixture of a modified polyester and a conventional polyester resin (not phenyl modified). Specific examples of saturated polyesters in conformity with this object are Vylon 200, Vylon 290, and Vylon 600 (all produced by Toyobo), KA-1038C (produced by Arakawa Kagaku), and TP220, AP235 (both produced by Nippon Gosei) under the trade designation.

Alternatively, the receiving layer can be constituted of the modified polyester resin and a vinyl chloride/vinyl acetate copolymer resin. The vinyl chloride/vinyl acetate copolymer resin is preferably one with a vinyl chloride content of about 85 to 97 wt.% and a polymerization degree of about 200 to 800. The vinyl chloride/vinyl acetate copolymer resin is not necessarily limited to copolymers containing only vinyl chloride component and vinyl acetate component, but is also inclusive of those containing vinyl alcohol component, maleic acid component, etc.

The receiving layer 3 may also be constituted of a resin mixture of the modified polyester resin and a polystyrene resin, for example, a polystyrene resin comprising homopolymer or copolymer of styrene monomers such as styrene, α-methylstyrene, and vinyl toluene, a styrene copolymer resin of the above styrene monomer with other monomers, including acrylic or methacrylic monomers such as acrylates, methacrylates, acrylonitrile, and methacrylonitrile, or maleic anhydride.

When the modified polyester resin is used in combination with another resin, the amount of the other resin, although it also depends on the modified polyester resin used, is preferably 0 to 100 parts by weight per 100 parts by weight of the modified polyester resin. In other words, when used in combination as described above, the modified polyester resin should comprise 50 to 100 g of the total resin weight of 100 g. In any of the above modes, for the purpose of improving the whiteness of the receiving layer 3 to enhance sharpness of the transferred image and also imparting writability to the dye receiving sheet surface as well as preventing retransfer of the transferred image, a white pigment can be added in the receiving layer 3. As the white pigment, titanium oxide, zinc oxide, kaolin, clay, calcium carbonate, fine powdery silica, etc. can be employed, and these can be used as a mixture of two or more kinds as described above. Also, for further enhancing the light resistance of the transferred image, one or two or more kinds of additives such as UV-ray absorbers, light stabilizers and antioxidants, can be added, if necessary. The amounts of these UV-ray absorbers, light stabilizers added is preferably 0.05 to 10 parts by weight and 0.5 to 3 parts by weight, respectively, per 100 parts of the resin constituting the receiving layer 3.

The dye receiving sheet of the present invention can contain a release agent for improvement of the release property with respect to the heat transfer sheet. As the release agent, solid waxes such as polyethylene wax, amide wax, and Teflon powder; fluorine type and phosphoric acid ester type surfactants; and silicone oils can be used, silicone oils being preferable.

As the above silicone oil, oily silicone can be used, but a cured type silicone oil is preferred. Examples of the cured type silicone oil are the reaction cured type, the photocured type, and the catalyst cured type, of which the reaction cured type silicone oil is particularly preferred. As the reaction cured type silicone oil, products obtained by the reaction curing between amino modified silicone oils and epoxy modified silicone oils are preferred. Examples of amino modified silicone oils are KF-393, KF-857, KF-858, X-22-3680, and X-22-3801C (all produced by Shinetsu Kagaku Kogyo K.K.), and examples of epoxy modified silicone oils are KF-100T, KF-101, KF-60-164, and KF-103 (all produced by Shinetsu Kagaku Kogyo K.K.), under the trade designation. On the other hand, as the catalyst cured type silicone oil or the photocured type silicone oil, there are KS-705F, KS-770 (all catalyst cured type silicone oils, produced by Shinetsu Kagaku Kogyo K.K.), KS-720, KS-774 (all photocured type silicone oils, produced by Shinetsu Kagaku Kogyo K.K.) under the trade designation. The amount of these cured type silicone oils added is preferably 0.5 to 30 wt.% of the resin constituting the image receiving layer. Also, on a part of the surface of the image receiving layer 3, a release agent can be provided by applying a coating of a solution or a dispersion of the above release agent in an appropriate solvent and then carrying out drying and other steps. As the release agent constituting the release agent, the reaction cured product of the above amino modified silicone oil and epoxy modified silicone oil is particularly preferred. The thickness of the release agent is preferably 0.01 to 5 μm, particularly 0.05 to 2 μm.

When the receiving layer is formed by adding a silicone oil thereto during its formation, and even when, after coating, curing is carried out after the silicone oil is caused to bleed out on the surface, the release agent layer can be formed.

The white pigment, UV-ray absorber, light stabilizer, antioxidant, release agent as mentioned above can be applied so as to be contained in the receiving layer on one surface or both surfaces.

Formation of the receiving layer 3 may also be practiced, in addition to the known coating or printing method by the use of a composition for formation of receiving layer obtained by dissolving or dispersing the materials for formation of the receiving layer, according to the method in which it is once formed on a separate tentative carrier different from the sheet substrate 2 and then transferred onto the sheet substrate 2.

As the tentative carrier, a sheet with releasable surface is used. For example, suitable sheets are ① those having an undercoat layer applied on the surface of cellulose fiber paper or synthetic paper and then a silicone layer for release applied thereover; ② those having extrusion coated polyolefin resin or polyester resin on cellulose fiber paper; and ③ those having a silicone layer for release applied on the surface of plastic films such as polyester film.

On the tentative carrier, after formation of the receiving layer similarly as on the sheet substrate, an adhesive layer is formed, if necessary. The adhesive layer is provided for ensuring adhesive force between the sheet substrate 2 and the receiving layer 3 when the image receiving layer is transferred onto the sheet substrate. According to this method, still another layer, for example, an intermediate layer for imparting cushioning property as described below may be formed on the tentative carrier so as to transfer at one time the intermediate layer and the receiving layer onto the sheet substrate 2. When the intermediate layer also functions as the adhesive layer, there is no necessity of forming an adhesive layer on the tentative layer. In any case, since the adhesive layer exists interposed between the tentative carrier and the uppermost layer, the adhesive layer may be also formed on the sheet substrate 2, while on the tentative carrier, only the receiving layer or the receiving layer and the intermediate layer may be successively formed.

When the method in which the receiving layer 3 is once formed on the tentative carrier and formed on the sheet substrate 2 according to the transfer method is employed, the surface of the receiving layer formed on the sheet substrate has excellent smoothness due to the state of the tentative carrier transferred, while the receiving layer formed directly on the sheet substrate is inferior in smoothness as compared with that according to the transfer method. Accordingly, if more sharp and precise images are desired, it is preferable to employ the transfer method.

As the adhesive, any adhesive which can bond the receiving layer to the substrate may be used. Examples of suitable adhesives are organic solvent solutions or emulsions of polyester type, polyacrylate type, polyurethane type, polyvinyl chloride type, polyolefin type, ethylene-vinyl acetate copolymer type, and synthetic type adhesives. The adhesive type may be either hot adhesion type or normal temperature adhesion type. In the hot adhesion type, hot melt adhesion with hot melt type adhesives such as wax, ethylene/vinyl acetate copolymer resin, polyolefin, and petroleum type resin, or sandwich lamination with an extrusion film of polyolefin film, etc. may be employed.

As an adhesive which functions also as the intermediate layer, double-side coated film may be used. Double-side coated tape comprises, for example, a rayon paper impregnated with an acrylic tackifier and dried, and on the double-side coated film after drying, there are formed microvoids, which seem to play a role equivalent to a foamed layer.

Intermediate layer

The intermediate layer 4 is either a cushioning layer or a porous layer depending on its constituent material, or in some cases it also functions as the adhesive.

The cushioning layer is composed mainly of a resin with a 100% modulus as defined by JIS-K-6301 of 100 $kg/cm^2$ or less. Here, if the above 100% modulus exceeds 100 $kg/cm^2$, due to excessive rigidity, sufficient close contact between the heat transfer sheet and the dye receiving layer during printing cannot be maintained even if an intermediate layer may be formed by the use of such a resin. On the other hand, the lower limit of the above 100% modulus is practically about 0.5 $kg/cm^2$.

Examples of the resins in conformity with the above conditions are:

polyurethane resins;
polyester resins;
polybutadiene resins;
polyacrylate resins;
epoxy resins;
polyamide resins;
rosin-modified phenol resins;
terpene phenol resins; and
ethylene/vinyl acetate copolymer resins.

Of the above resins, one resin or a mixture of two or more resins can be used, but since the above resins are relatively tacky, if there is trouble in processing, inorganic additives such as silica, alumina, clay, calcium carbonate, or amide type substances such as stearic acid amide may also be added.

The cushioning layer can be formed by kneading the resin as described above optionally together with other additives with a solvent, diluent, etc. to form a paint or an ink, which is in turn dried as a coating according to a known coating method or printing method, its thickness being about 0.5 to 50 μm, more preferably about 2 to 20 μm. With a thickness less than 0.5 μm, the roughness on the sheet substrate cannot be absorbed and therefore there is no effect, while, on the contrary, with a thickness exceeding 50 μm, improvement in effect cannot be seen, and also the receiving layer portion becomes so thick as to protrude out, which may cause trouble in winding or stacking, which also is not economical.

Improvement in close contact between the heat transfer sheet and the dye receiving sheet by formation of such an intermediate layer may be considered to be due to deformation of the intermediate layer itself, which has low rigidity, by the pressure during printing, but another contribution may also be presumably the fact that the resin as described above generally has a lower glass transition point or softening point to be further lowered in rigidity and readily deformable than at normal temperature by the energy imparted during printing.

The porous layer 3 which can be used is (1) a layer formed by applying a synthetic resin emulsion of polyurethane, etc., a synthetic rubber latex of methyl methacrylate-butadiene type, etc. which has been foamed by mechanical stirring on the substrate 2 and then drying the same; (2) a layer formed by applying a mixture of the above synthetic emulsion, the above synthetic rubber latex with a foaming agent of the substrate 2 and then drying the same; (3) a foamed layer formed by applying a mixture of a synthetic resin such as vinyl chloride plastic sol, polyurethane, etc. or a synthetic rubber with a foaming agent on the substrate 2, and then heating the same; (4) a microporous layer comprising microscopically agglomerated films formed by applying a mixture of a solution of a thermoplastic resin or a synthetic rubber dissolved in an organic solvent and a non-solvent which is more difficult to evaporate than said organic solvent, has compatibility with said organic solvent and has no solubility for thermoplastic resin and synthetic rubber (including those composed mainly of water) on the substrate 2 and then drying the same.

Since the above layers 1, 2, and 3 include foams which are of great size, when a solution for formation of the receiving layer 3 is applied on said layer and dried, there is a possibility of uneveness being formed on the surface on the receiving layer formed by drying. For this reason, for obtaining a surface of the receiving layer 3 which has little uneveness as mentioned above and can also effect transfer with high uniformity, it is preferable to provide the above microporous layer (4).

As the thermoplastic resin to be used in the formation of the above microporous layer, saturated polyesters, polyurethanes, vinyl chloride/vinyl acetate copolymers, cellulose acetate propionate, etc. may be mentioned, while as the above synthetic rubber similarly employed, styrene-butadiene type, butadiene type, isoprene type, urethane type synthetic rubbers may be employed. Also, as the organic solvent and non-solvent to be used in formation of said microporous layer, various kinds of solvents can be used, but ordinarily hydrophilic solvents such as methyl ethyl ketone, and alcohols are employed as the organic solvent, while water is used as the non-solvent.

The porous layer in the present invention is of a thickness which is preferably 3 μm or more, particularly 5 to 20 μm. A porous layer with a thickness less than 3 μm cannot exhibit the effects of cushioning property and thermal insulation.

As described previously in the description of the method for forming the receiving layer, the intermediate layer in some cases may also function as the adhesive layer.

The above intermediate layer is provided either on both surfaces or on one surface of the dye receiving sheet, when there are receiving layers on both surfaces.

Lubricating layer

In the present invention, a lubricating layer can be provided on the back (the surface where there is no receiving layer) of the sheet substrate.

The lubricating layer is provided for facilitating removal of the dye receiving sheets one by one, and those comprising various materials may be employed. However, a typical lubricating layer is one readily slidable between the lubricating layer surface and the receiving layer surface of the dye receiving sheet adjacent thereto, in other words, having a small static frictional coefficient.

Such a lubricating layer comprises a coating of a synthetic resin as exemplified by methacrylate resins such as methyl methacrylate resin or corresponding acrylate resins, vinyl type resins such as vinyl chloride/-vinyl acetate copolymer resins.

It was entirely unexpected that the coating film of these synthetic resins could have be effective in removing one by one the dye receiving sheets, and no such effect as expected can be obtained by merely providing an antistatic layer on the back of the substrate 2.

The lubricating layer can be formed by kneading the synthetic resin constituting the layer together with other components optionally added (e.g., polyethylene wax, fluorine resin powder, and microsilica) to be formed into a coating material, coating the material according to the same method as that used for the receiving layer, and then drying. Its thickness is 1 to 10 μm.

Antistatic agent

For suppressing generation of static charges during the processing steps of the dye receiving sheet or during running in the printer, an antistatic agent can also be contained in the receiving layer or on the surface of the receiving layer on at least one surface. As the antistatic agent, surfactants such as cationic surfactants (e.g., quaternary ammonium salts and polyamine derivatives), nonionic surfactants (e.g., alkyl phosphates , amphoteric surfactants or nonionic surfactants can be used.

The antistatic agent may be formed by coating on the receiving layer surface by gravure coating, bar coating, etc., or alternatively kneaded into the receiving layer resin so as to migrate onto the receiving layer surface during coating and drying of the receiving layer. As the antistatic agent to be mixed with the receiving layer resin, a cationic acrylic polymer can be also used.

In the following, the present invention is described in more detail by referring to Examples. In the following Examples and Comparative Examples, preparation of heat transfer sheets and dye receiving sheets, printing by use of both sheets and tests of dye receiving sheets were conducted as follows.

Heat transfer sheet

By use of a polyethylene terephthalate film (produced by Toyobo: S-PET with a thickness of 6 μm applied with corona discharging treatment on one surface as the substrate, the composition for formation of a heat transfer layer having the composition shown below was applied by a wire bar to a thickness of 1 μm on drying to form a heat transfer layer on the surface of the substrate where corona discharging treatment was applied, while two drops of a silicone oil (X-41-4003A: produced by Shinetsu Silicone) with a fountain pen filler were dropped on the back surface and spread over the entire surface to form a lubricating surface to produce a heat transfer sheet.

Composition for formation of heat transfer layer

| | |
|---|---|
| Disperse dye (Kayaset Blue 714, produced by Nippon Kayaku) | 4 wt. parts |
| Ethylhydroxy cellulose (produced by Hercules Co.) | 5 wt. parts |
| Toluene | 40 wt. parts |
| Methyl ethyl ketone | 40 wt. parts |
| Dioxane | 10 wt. parts |

Heat transferable sheet

By use of a synthetic paper (Yupo EPG-150, produced by Oji Yuka K.K.) with a thickness of 150 μm, a composition for forming a receiving layer having the composition shown below was applied on the surface thereof by wire bar coating to a thickness of 4 μm on drying and, after tentative drying by a dryer, dried in an oven of 100° C for 30 minutes to form a receiving layer to obtain a dye receiving sheet.

Composition for formation of receiving layer

| | |
|---|---|
| Resin | 14 wt. parts |
| Amino modified silicone oil (KF-396, produced by Shinetsu Kagaku Kogyo K.K.) | 1 wt. part |
| Toluene | 42 wt. parts |
| Methyl ethyl ketone | 42 wt. parts |

The above heat transfer sheet and dye receiving sheet were superposed on one another so that the heat transfer layer contacted the receiving layer and heated from the substrate side of the heat transfer sheet by a thermal head at an output of the thermal head of 1W/dot, pulse width of 0.3 - 0.45 m/sec., and dot density of 3 dots/mm, to effect transfer of the disperse dye of cyan color in the heat transfer layer of the heat transfer sheet to the receiving layer in the dye receiving sheet, whereby an image of cyan color was sharply formed.

Synthesis of modified polyester resin

The respective components shown in the following Examples, a minute amount of calcium acetate as the catalyst and antimony trioxide were charged into a Claisan flask type reactor equipped with an air condenser; the temperature was gradually raised in $N_2$ atmosphere and maintained at about 150° C; and reaction was carried out at this temperature with stirring for one hour. Then, the reaction product was placed in a Pyrex tube, with $O_2$ being completely shut off, and polycondensation was effected under the conditions of 275° C., 0.1 to 0.05 mm Hg, to obtain a modified polyester resin. The resin thus obtained was used as the resin component for the composition for formation of the receiving layer of the above dye receiving sheet.

EXAMPLE A-1

| | |
|---|---|
| Acid components | |
| terephthalic acid | 80 wt. parts |
| isophthalic acid | 20 wt. parts |
| Polyol components | |
| ethylene glycol | 50 wt. parts |
| bisphenol A | 50 wt. parts |

EXAMPLE A-2

| | |
|---|---|
| Acid components | |
| terephthalic acid | 40 wt. parts |
| isophthalic acid | 40 wt. parts |
| sebacic acid | 20 wt. parts |
| Polyol components | |
| ethylene glycol | 40 wt. parts |
| neopentyl glycol | 40 wt. parts |
| bisphenol B | 20 wt. parts |

EXAMPLE A-3

A mixture of the modified polyester obtained in Example A-1 and a vinyl chloride/vinyl acetate copolymer resin (Vinilite VYHH, produced by Union Carbide) mixed at 1:1 was employed.

COMPARATIVE EXAMPLE A-1

| | |
|---|---|
| Acid components | |
| terephthalic acid | 40 wt. parts |
| isophthalic acid | 40 wt. parts |
| sebacic acid | 20 wt. parts |
| Polyol components | |
| ethylene glycol | 50 wt. parts |
| neopentyl glycol | 50 wt. parts |

When a dye receiving sheet was formed by use of the resin obtained above and printing was conducted, it was found that the products in Examples A-1 to A-3 were found to be improved in optical reflection density by 0.2 to 0.5 as compared with the product in Comparative Example A-1.

EXAMPLE B-1

| | |
|---|---|
| Acid components | |
| terephthalic acid | 40 wt. parts |
| isophthalic acid | 40 wt. parts |
| nonane dicarboxylic acid | 20 wt. parts |
| Polyol components | |
| ethylene glycol | 50 wt. parts |
| bisphenol A | 50 wt. parts |

EXAMPLE B-2

| | |
|---|---|
| Acid components | |
| terephthalic acid | 40 wt. parts |
| isophthalic acid | 40 wt. parts |

-continued

| | |
|---|---|
| dodecane dicarboxylic acid | 20 wt. parts |
| Polyol components | |
| ethylene glycol | 50 wt. parts |
| neopentyl glycol | 50 wt. parts |

EXAMPLE B-3

A mixture of the modified polyester obtained in Example B-1 and a polystyrene resin (Picolastic D 125, produced by Rika Hercules) mixed in a weight ratio of 1:1 was used.

COMPARATIVE EXAMPLE B-1

| | |
|---|---|
| Acid components | |
| terephthalic acid | 50 wt. parts |
| isophthalic acid | 50 wt. parts |
| Polyol components | |
| ethylene glycol | 50 wt. parts |
| neopentyl glycol | 50 wt. parts |

When a dye receiving sheet was formed by the use of the resin obtained above and printing was effected, the products obtained in Examples B-1 to B-3 were all excellent in light resistance without fading, but the product of Comparative Example B-1 was markedly faded after irradiation of the grade 3 (JIS).

EXAMPLE C-1

| | |
|---|---|
| Acid components | |
| terephthalic acid | 40 wt. parts |
| isophthalic acid | 40 wt. parts |
| nonane dicarboxylic acid | 20 wt. parts |
| Polyol components | |
| ethylene glycol | 40 wt. parts |
| neopentyl glycol | 40 wt. parts |
| bisphenol A | 20 wt. parts |

EXAMPLE C-2

| | |
|---|---|
| Acid components | |
| terephthalic acid | 40 wt. parts |
| isophthalic acid | 40 wt. parts |
| dodecane dicarboxylic acid | 20 wt. parts |
| Polyol components | |
| ethylene glycol | 50 wt. parts |
| bisphenol B | 50 wt. parts |

EXAMPLE C-3

A mixture of the modified polyester resin obtained in Example C-1 and a vinyl chloride/vinyl acetate copolymer resin (Vinilite VYHH, produced by Union Carbide) mixed in a weight ratio of 1:1 was used.

COMPARATIVE EXAMPLE C-1

| | |
|---|---|
| Acid components | |
| terephthalic acid | 40 wt. parts |
| isophthalic acid | 40 wt. parts |
| sebacic acid | 20 wt. parts |
| Polyol components | |
| ethylene glycol | 50 wt. parts |
| neopentyl glycol | 50 wt. parts |

When a dye receiving sheet was formed by the use of the resin obtained above and printing was effected, the products obtained in Examples C-1 to C-3 were found to be improved in optical reflective density by 0.2 to 0.5 as compared with the product in Comparative Example C-1.

EXAMPLE D-1

| | |
|---|---|
| Acid components | |
| terephthalic acid | 30 wt. parts |
| isophthalic acid | 68 wt. parts |
| hexadecane dicarboxylic acid | 2 wt. parts |
| Polyol components | |
| ethylene glycol | 40 wt. parts |
| bisphenol A | 60 wt. parts |

EXAMPLE D-2

| | |
|---|---|
| Acid components | |
| terephthalic acid | 50 wt. parts |
| isophthalic acid | 50 wt. parts |
| Polyol components | |
| ethylene glycol | 40 wt. parts |
| bisphenol A | 60 wt. parts |
| neopentyl glycol | 20 wt. parts |

COMPARATIVE EXAMPLE D-1

| | |
|---|---|
| Acid components | |
| terephthalic acid | 70 wt. parts |
| isophthalic acid | 30 wt. parts |
| Polyol components | |
| ethylene glycol | 35 wt. parts |
| neopentyl glycol | 35 wt. parts |

When printing was performed by forming dye receiving sheets by use of the resins obtained in the respective Examples, as to light resistance, the above Example D-1 was found to have a fading ratio of 5% or less in the grade 3 irradiation according to JIS standard, but the fading ratio was 10% or higher in Comparative Example D-1.

Also, when values of optical reflective densities relative to the applied energy were measured for the above Example D-2 and Comparative Example D-1, the product of Example D-2 exhibited good dyeability as shown in FIG. 3. In the above Example, optical reflective density was measured by use of COSAR-61J (produced by Cosar Co.). The abscissa in FIG. 3 indicates the proportion of the magnitude of printing energy.

EXAMPLE E-1

The following acid components and polyol components were prepared.

| | |
|---|---|
| Acid components | |
| terephthalic acid | 20 wt. parts |
| isophthalic acid | 20 wt. parts |
| sebacic acid | 10 wt. parts |
| 1,2-diphenyl-1,2-ethanecarboxylic acid | 50 wt. parts |
| Polyol components | |
| ethylene glycol | 25 wt. parts |
| neopentyl glycol | 25 wt. parts |
| 1,2-diphenyl-1,2-ethanediol | 50 wt. parts |

Among these, 1,2-diphenyl-1,2-ethanecarboxylic acid was obtained by reaction of α-bromocarboxylic acid with KCN, followed by carboxylation, and others are commercial products.

The above components and minute amounts of calcium acetate and antimony trioxide as the catalyst were charged into a Claisen flask type reactor, and the temperature was gradually raised in $N_2$ atmosphere and maintained at about 150° C. At this temperature, the reaction was carried out with stirring for one hour. Then the reaction product was placed in a Pyrex tube equipped with a thermocouple to be completely shut off from oxygen, and polycondensation was carried out under the conditions of 275° C., 0.1 to 0.05 mm Hg for 2 hours to obtain a phenyl modified ester resin.

EXAMPLE E-2

A phenyl modified polyester resin was synthesized in the same manner as in Example E-1 by the use of the following components and was used.

| | |
|---|---|
| Acid components | |
| terephthalic acid | 20 wt. parts |
| isophthalic acid | 20 wt. parts |
| sebacic acid | 10 wt. parts |
| 1,2-diphenyl-1,2-ethanecarboxylic acid | 50 wt. parts |
| Polyol components | |
| ethylene glycol | 55 wt. parts |
| neopentyl glycol | 50 wt. parts |

EXAMPLE E-3

A phenyl modified polyester resin was synthesized in the same manner as in Example E-1 by the use of the following components and was used.

| | |
|---|---|
| Acid components | |
| terephthalic acid | 25 wt. parts |
| isophthalic acid | 25 wt. parts |
| sebacic acid | 50 wt. parts |
| Polyol components | |
| ethylene glycol | 25 wt. parts |
| neopentyl glycol | 25 wt. parts |
| 1,2-diphenyl-1,2-ethanediol | 50 wt. parts |

EXAMPLE E-4

A phenyl modified polyester resin was synthesized in the same manner as in Example E-1 by the use of the following components, and used.

| | |
|---|---|
| Acid components | |
| terephthalic acid | 20 wt. parts |
| isophthalic acid | 20 wt. parts |
| sebacic acid | 10 wt. parts |
| 1,2-diphenyl-1,2-ethanecarboxylic acid | 50 wt. parts |
| Polyol components | |
| ethylene glycol | 25 wt. parts |
| neopentyl glycol | 25 wt. parts |
| phenylethylene glycol | 50 wt. parts |

EXAMPLE E-5

A mixture of the phenyl modified polyester resin obtained in Example E-1 and a conventional saturated polyester resin (Vylon 200, produced by Toyobo) mixed in a weight ratio of 1:1 was used.

EXAMPLE E-6

A mixture of the phenyl modified polyester resin obtained in Example E-1 and a vinyl chloride/vinyl acetate copolymer resin (Vinilite VYHH, produced by Union Carbide) mixed in a weight ratio of 1:1 was used.

EXAMPLE E-7

A mixture of the phenyl modified polyester resin obtained in Example E-1 and a polystyrene resin (Picolastic D125, produced by Rika Hercules) mixed in a weight ratio of 1:1 was used.

EXAMPLE E-8

A mixture of the phenyl modified polyester resin obtained in Example E-1 and a styrene-acrylic acid copolymer resin (Sebian No. 50, produced by Dicel Kagaku) mixed in a weight ratio of 1:1 was used.

COMPARATIVE EXAMPLE E-1

In Example E-1, the phenyl modified acid component and the phenyl modified polyol component were excluded, and the following components were used. By following otherwise the same procedure as in Example E-1, a phenyl modified polyester resin was synthesized and used.

| | |
|---|---|
| Acid components | |
| terephthalic acid | 25 wt. parts |
| isophthalic acid | 25 wt. parts |
| sebacic acid | 50 wt. parts |
| Polyol components | |
| ethylene glycol | 50 wt. parts |
| neopentyl glycol | 50 wt. parts |

Color fading ratios in the dye receiving sheets obtained in the above Examples E-1 to E-8 and the Comparative Example E-1 are shown in Table 1.

TABLE 1

| | Presence of phenyl component | | | Fading ratio | | |
|---|---|---|---|---|---|---|
| | in acid component | in polyol component | Blended resin | ① | ② | ③ |
| Example E-1 | Yes | Yes | — | 5 | 10 | 12 |
| Example E-2 | Yes | None | — | 11 | 15 | 19 |
| Example E-3 | None | Yes | — | 15 | 17 | 16 |
| Example E-4 | Yes | Yes | — | 7 | 11 | 16 |
| Example E-5 | Yes | Yes | polyester | 16 | 13 | 7 |
| Example E-6 | Yes | Yes | VCl/VAc* | 3 | 14 | 4 |
| Example E-7 | Yes | Yes | Pst** | 3 | 16 | 9 |
| Exampel E-8 | Yes | Yes | St/AA*** | 1 | 12 | 9 |
| Comparative Exampel E-1 | None | None | — | 91 | 82 | 98 |

*VCl/VAc = vinyl chloride/vinyl acetate
**Pst = polystyrene
***St/AA = styrene/acrylic acid
In the above Table, ①, ②, and ③ show the values in:
① . . . light resistance test,
② . . . heat resistance, humidity resistance test,
③ . . . weathering resistance test.

The light resistance, the heat resistance, humidity resistance and the weathering resistance in the above respective examples were conducted under the following conditions.

①Light resistance test

The light resistance test was conducted by effecting exposure to light under the conditions based on JIS-L0842, and the image density $D_1$ immediately after printing and before the light resistance test and the image density $D_2$ after the light resistance test were measured, and evaluated in terms of fading ratio $D=(D_2/D_1)\times 100$ (%).

②Heat resistance, humidity resistance test

A dye receiving sheet after printing was maintained in a hot atmosphere of a temperature of 60° C and a relative humidity of 90%, and the fading ratio was measured similarly as in the light resistance test.

③Weathering resistance test

This was conducted in the same manner as in the light resistance test except that the exposure environment was set under the conditions of a temperature of 40° C. and a relative humidity of 80%, and the fading ratio was measured.

As is also apparent from the results of the above Examples, the dye receiving sheet of the present invention, by constituting its receiving layer by the use of a modified polyester resin synthesized by the use of a polyol having phenyl group and/or a dicarboxylic acid having long chain methylene group, the image formed by printing with a thermal head, etc. by combination with a heat transfer sheet has high density due to the polyol component, and without lowering in sharpness by blurring of color or unfocusing even after prolonged storage due to the dicarboxylic acid component, whereby no such inconvenience such as discoloration will occur.

According to the dye receiving sheet of the present invention, since the receiving layer is excellent in dyeability of dye, and further the image formed on the receiving layer has excellent light resistance (weathering resistance), it is very effective in the field of image formation according to the heat-transfer system where sharpness and stability with elapse of time are demanded.

What is claimed is:

1. A thermal dye transfer system, comprising:
a heat transfer sheet comprising a dye layer containing a fusible or sublimable dye;
a sheet substrate; and
dye receiving layer formed on at least one surface of said sheet substrate for receiving said dye which migrates from said heat transfer sheet during heating printing, said dye receiving layer comprising a phenyl group modified polyester resin synthesized by the use of a polyol having a phenyl group as the polyol component.

2. The thermal dye transfer system of claim 1, wherein said polyol having a phenyl group is selected from the group consisting of bisphenyl A, bisphenyl B, bisphenyl AF, bisphenyl S and mixtures of these polyols with polyols having no phenyl group.

3. The thermal dye transfer system of claim 1, wherein said dye receiving layer comprises a blend resin comprising a modified polyester resin and another resin.

4. The thermal dye transfer system of claim 1, wherein an intermediate layer is provided between the sheet substrate and the dye receiving layer.

5. The thermal dye transfer system of claim 4, wherein said intermediate layer comprises a cushioning layer or a porous layer with a 100% modulus of not greater than 100 kg/cm$^2$.

6. The thermal dye transfer system of claim 1, wherein said dye receiving layer and/or said sheet substrate contain an antistatic agent.

7. The thermal dye transfer system of claim 1, wherein an antistatic agent layer is formed on the surface of said dye receiving layer and/or on the surface of said sheet substrate.

8. A thermal dye transfer system, comprising:

a heat transfer sheet comprising a dye layer containing a fusible or sublimable dye;

a sheet substrate; and a dye receiving layer formed on at least one surface of said sheet substrate for receiving said dye which migrates from said heat transfer sheet during heating printing, said dye receiving layer comprising a long chain methylene group modified polyester resin synthesized by the use of a dicarboxylic acid having a long chain methylene group as the acid component.

9. The thermal dye transfer system of claim 8, wherein said dicarboxylic acid having a long chain methylene group is represented by the formula:

$$HOOC(CH_2)_nCOOH,$$

wherein n is not less than 6 and not greater than 30.

10. The thermal dye transfer system of claim 8, wherein said dye receiving layer comprises a blend resin comprising a modified polyester resin and another resin.

11. The thermal dye transfer system of claim 8, wherein an intermediate layer is provided between the sheet substrate and the dye receiving layer.

12. The thermal dye transfer system of claim 11, wherein said intermediate layer comprises a cushioning layer or a porous layer with a 100% modulus of not greater than 100 kg/cm$^2$.

13. The thermal dye transfer system of claim 8, wherein said dye receiving layer and/or said sheet substrate contain an antistatic agent.

14. The thermal dye transfer system of claim 8, wherein an antistatic agent layer is formed on the surface of said dye receiving layer and/or on the surface of said sheet substrate.

15. A thermal dye transfer system, comprising:

a heat transfer sheet comprising a dye layer containing a fusible or sublimable dye;

a sheet substrate; and a dye receiving layer formed on at least one surface of said sheet substrate for receiving said dye which migrates from said heat transfer sheet during heating printing, said dye receiving layer comprising a modified polyester resin synthesized by the use of a polyol component having a phenyl group and a dicarboxylic acid having a long chain methylene group.

16. The thermal dye transfer system of claim 15, wherein said dye receiving layer comprises a blend resin comprising a modified polyester resin and another resin.

17. The thermal dye transfer system of claim 15, wherein an intermediate layer is provided between the sheet substrate and the dye receiving layer.

18. The thermal dye transfer system of claim 17, wherein said intermediate layer comprises a cushioning layer or a porous layer with a 100% modulus of not greater than 100 kg/cm$^2$.

19. The thermal dye transfer system of claim 15, wherein said dye receiving layer and/or said sheet substrate contain an antistatic agent.

20. The thermal dye transfer system of claim 15, wherein an antistatic agent layer is formed on the surface of said dye receiving layer and/or on the surface of said sheet substrate.

21. A method of imaging a dye receiving sheet, comprising:

providing a heat transfer sheet comprising a dye layer containing a fusible or sublimable dye;

providing a dye receiving sheet comprising a sheet substrate and a dye receiving layer comprising a phenyl group modified polyester resin synthesized by the use of a polyol having a phenyl group as the polyol component;

contacting the dye layer of said heat transfer sheet to the dye receiving layer of said dye receiving sheet; and heating the contacting sheets to transport said fusible or sublimable dye from the dye layer of said heat transfer sheet to the dye receiving layer of said dye receiving sheet.

22. The method of claim 21, wherein said polyol having a phenyl group is selected from the group consisting of bisphenyl A, bisphenyl B, bisphenyl AF, bisphenyl S and mixtures of these polyols with polyols having no phenyl group.

23. A method of imaging a dye receiving sheet, comprising:

providing a heat transfer sheet comprising a dye layer containing a fusible or sublimable dye;

providing a dye receiving sheet comprising a sheet substrate and a dye receiving layer comprising a long chain methylene group modified polyester resin synthesized by the use of a dicarboxylic acid having a long chain methylene group as the acid component;

contacting the dye layer of said heat transfer sheet to the dye receiving layer of said dye receiving sheet; and heating the contacting sheets to transport said fusible or sublimable dye from the dye layer of said heat transfer sheet to the dye receiving layer of said dye receiving sheet.

24. The method of claim 23, wherein said dicarboxylic acid having a long chain methylene group is represented by the formula $$HOOC(CH_2)_nCOOH,$$

wherein n is not less than 6 and not greater than 30.

25. A method of imaging a dye receiving sheet, comprising:

providing a heat transfer sheet comprising a dye layer containing a fusible or sublimable dye;

providing a dye receiving sheet comprising a sheet substrate and a dye receiving layer comprising a modified polyester resin synthesized by the use of a polyol component having a phenyl group and a dicarboxylic acid having a long chain methylene group;

contacting the dye layer of said heat transfer sheet to the dye receiving layer of said dye receiving sheet; and heating the contacting sheets to transport said fusible or sublimable dye from the dye layer of said heat transfer sheet to the dye receiving layer of said dye receiving sheet.

* * * * *